US010096444B2

(12) United States Patent
Roehrig et al.

(10) Patent No.: US 10,096,444 B2
(45) Date of Patent: Oct. 9, 2018

(54) AVOIDING INCORRECT ORIENTATIONS OF A DRIVE ROD OF A POWER SWITCH

(71) Applicant: Siemens Aktiengesellschaft, Munich (DE)

(72) Inventors: Fabian Roehrig, Berlin (DE); Unni Suresh, Berlin (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 0 days.

(21) Appl. No.: 15/318,554

(22) PCT Filed: Jun. 5, 2015

(86) PCT No.: PCT/EP2015/062608
§ 371 (c)(1),
(2) Date: Dec. 13, 2016

(87) PCT Pub. No.: WO2016/000907
PCT Pub. Date: Jan. 7, 2016

(65) Prior Publication Data

US 2017/0133181 A1 May 11, 2017

(30) Foreign Application Priority Data

Jun. 30, 2014 (DE) ..... 10 2014 212 583

(51) Int. Cl.
*H01H 33/666* (2006.01)
*H01H 11/04* (2006.01)

(52) U.S. Cl.
CPC ..... *H01H 33/666* (2013.01); *H01H 11/04* (2013.01); *H01H 2033/6667* (2013.01)

(58) Field of Classification Search
CPC ..... H01H 33/666; H01H 2033/6667; H01H 11/04
(Continued)

(56) References Cited

U.S. PATENT DOCUMENTS 3,189,715 A * 6/1965 Jennings ..... H01H 33/66 174/142
3,261,954 A 7/1966 Yonkers
(Continued)

FOREIGN PATENT DOCUMENTS

CN 201075805 Y 6/2008
CN 203339047 U 12/2013
(Continued)

OTHER PUBLICATIONS

German Office Action dated Apr. 24, 2015.
(Continued)

*Primary Examiner* — Renee S Luebke
*Assistant Examiner* — William Bolton
(74) *Attorney, Agent, or Firm* — Harness, Dickey & Pierce, P.L.C.

(57) ABSTRACT

A power switch includes a vacuum interrupter held in a pole shell including a fixed contact and a moving contact, and a drive rod embodied in an electrically insulating fashion in order to apply a driving movement of a switch drive to the moving contact in order to open and close the contact system of the vacuum interrupter. Furthermore, a method is disclosed for avoiding incorrect orientations of the drive rod of such a power switch. A guide and/or centering element is proposed, connected to the drive rod and provided radially between the drive rod and the pole shell to bring about independent axial orientation of the drive rod in the pole shell.

23 Claims, 3 Drawing Sheets

(58) Field of Classification Search
USPC ..... 218/120, 140, 153, 154, 136
See application file for complete search history.

(56) References Cited

U.S. PATENT DOCUMENTS

| | | | | |
|---|---|---|---|---|
| 3,440,377 | A | 4/1969 | Wesoloski | |
| 3,594,525 | A * | 7/1971 | Miller | H01H 33/008 200/337 |
| 4,061,894 | A * | 12/1977 | Crouch | H01H 33/66261 218/133 |
| 4,443,672 | A | 4/1984 | Oeschger | |
| 5,597,992 | A * | 1/1997 | Walker | H01H 33/6606 218/121 |
| 6,495,786 | B1 * | 12/2002 | Tsuji | H01H 33/668 218/118 |
| 6,649,854 | B1 * | 11/2003 | Bauer | H01H 33/666 218/120 |
| 6,917,006 | B2 * | 7/2005 | Bachofen | H01H 3/3052 200/400 |
| 7,115,831 | B2 * | 10/2006 | Chyla | H01H 1/5833 218/124 |
| 8,426,759 | B2 * | 4/2013 | Nagatake | H01H 1/50 218/140 |
| 2015/0114933 | A1 | 4/2015 | Reuber | |

FOREIGN PATENT DOCUMENTS

| | | | |
|---|---|---|---|
| DE | 19814398 | C1 | 12/1999 |
| EP | 2575153 | A2 | 4/2013 |
| EP | 2682974 | A1 | 1/2014 |
| GB | 1123629 | A | 8/1968 |

OTHER PUBLICATIONS

International Search Report PCT/ISA/210 for International Application No. PCT/EP2015/062608 dated Sep. 10, 2015.
Writon Opinion of the International Searching Authority PCT/ISA/237 for International Application No. PCT/EP2015/062608 dated Sep. 10, 2015.
Chinese Office Action dated Dec. 12, 2017.

* cited by examiner

AVOIDING INCORRECT ORIENTATIONS OF A DRIVE ROD OF A POWER SWITCH

PRIORITY STATEMENT

This application is the national phase under 35 U.S.C. § 371 of PCT International Application No. PCT/EP2015/062608 which has an International filing date of Jun. 5, 2015, which designated the United States of America and which claims priority to German patent application number DE 102014212583.9 filed Jun. 30, 2014, the entire contents of which are hereby incorporated herein by reference.

FIELD

An embodiment of the invention generally relates to a circuit breaker comprising a vacuum interrupter, accommodated in a pole shell and including a fixed contact and a moving contact, and also comprising a drive rod, which is of electrically insulating design, for introducing a drive movement from a switch drive into the moving contact in order to open and close the contact system of the vacuum interrupter. An embodiment of the invention furthermore generally relates to a method for avoiding incorrect orientations of a drive rod of a circuit breaker.

BACKGROUND

In order to open and close the contact system of a vacuum interrupter, a moving contact moves along a central axis of the vacuum interrupter relative to a fixed contact. A switch drive provides a corresponding drive movement. A drive rod, which is of electrically insulating design and connects the switch drive to the vacuum interrupter, serves to introduce the drive movement into the moving contact connection bolt of the vacuum interrupter. Misaligned positions of this drive rod can occur both during assembly of the switch pole of the circuit breaker and also during operation of the circuit breaker.

The prior art discloses designing the stationary and/or the movable contact piece such that adequate functioning of the contact arrangement is ensured even when the drive rod is misaligned. This solution is expensive since particularly large contact areas are required.

The prior art likewise discloses using guide systems in order to preclude malfunctions of the switch pole from the outset for the purpose of avoiding incorrect orientations of the kind. Additional components and structural elements which are fitted to the pole shell, such as special guide bearings for example, are used for this purpose, as a result of which the structural design of the switch pole becomes comparatively complex.

SUMMARY

An embodiment of the present invention provides a particularly simple and at the same time low-cost solution for avoiding incorrect orientations of the drive rod.

At least one embodiment is directed to a circuit breaker and, respectively, at least one embodiment is directed to a method. Advantageous embodiments of the invention are specified in the claims. The advantages and refinements explained in the text which follows in connection with embodiments of the circuit breaker analogously also apply to embodiments of the method, and vice versa.

The circuit breaker according to at least one embodiment of the invention comprises a vacuum interrupter, which is accommodated in a pole shell and has a fixed contact and a moving contact, a drive rod, which is of electrically insulating design, for introducing a drive movement from a switch drive into the moving contact in order to open and close the contact system of the vacuum interrupter, and also a guide and/or centering element(s) which is provided radially between the drive rod and the pole shell and is designed to automatically axially orient the drive rod in the pole shell, wherein the guide and/or centering element(s) is connected to the drive rod.

The circuit breaker according to at least one embodiment of the invention comprises a vacuum interrupter, accommodated in a pole shell and including a fixed contact and a moving contact; and a drive rod, of electrically insulating design, to introduce a drive movement from a switch drive into the moving contact in order to at least one of open and close a contact system of the vacuum interrupter, a guide and/or centering element being connected to the drive rod and being a constituent part of the drive rod, provided radially between the drive rod and the pole shell, the guide and/or centering element being configured to automatically axially orient the drive rod in the pole shell.

The method according to at least one embodiment of the invention for avoiding incorrect orientations of a drive rod of a circuit breaker is distinguished in that the drive rod is automatically axially oriented in the pole shell. This self-orientation is performed with the aid of a guide and centering element(s) which is provided radially between the drive rod and the pole shell and is connected to the drive rod.

BRIEF DESCRIPTION OF THE DRAWINGS

The above-described properties, features and advantages of this invention and the way in which they are achieved will become clearer and easier to understand in connection with the following description of the example embodiments which will be explained in greater detail in connection with the drawings, in which.

All of the figures show embodiments of the invention only schematically and with the essential constituent parts of the invention. In the figures, identical reference symbols correspond to elements which have the same or a comparable function.

DETAILED DESCRIPTION OF THE EXAMPLE EMBODIMENTS

Figure 1:
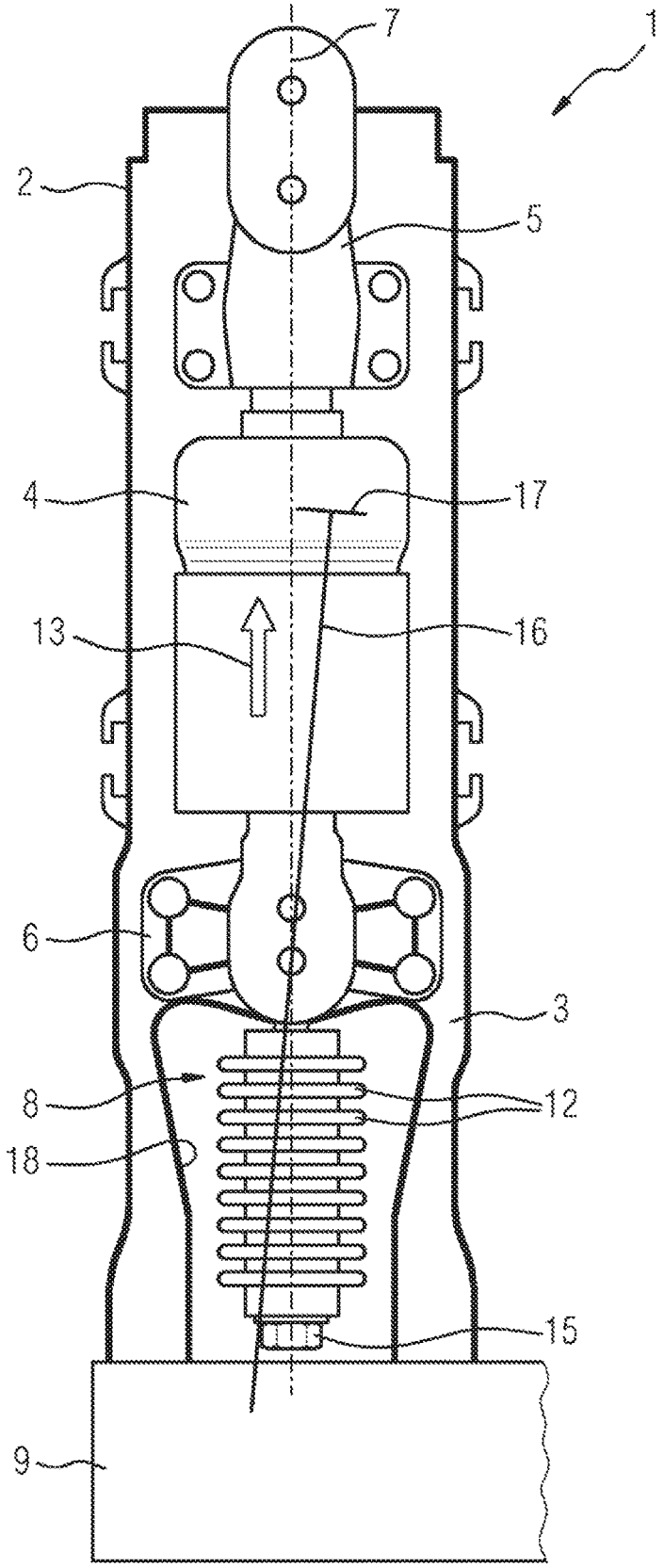
FIG 1 Prior art
FIG. 1 shows a switch pole of a conventional circuit breaker.

The circuit breaker according to at least one embodiment of the invention comprises a vacuum interrupter, which is accommodated in a pole shell and has a fixed contact and a moving contact, a drive rod, which is of electrically insulating design, for introducing a drive movement from a switch drive into the moving contact in order to open and close the contact system of the vacuum interrupter, and also a guide and/or centering element(s) which is provided radially between the drive rod and the pole shell and is designed to automatically axially orient the drive rod in the pole shell, wherein the guide and/or centering element(s) is connected to the drive rod.

The method according to at least one embodiment of the invention for avoiding incorrect orientations of a drive rod of a circuit breaker is distinguished in that the drive rod is automatically axially oriented in the pole shell. This self-orientation is performed with the aid of a guide and centering element(s) which is provided radially between the drive rod and the pole shell and is connected to the drive rod.

A basic idea of at least one embodiment of the invention is to provide a drive rod which centers itself in the pole shell. The structural devices required for the self-orientation are themselves fitted to the drive rod in this case. These structural devices are preferably themselves fitted exclusively to the drive rod, so that changes to the pole shell are not required. Lateral movements of the drive rod in the pole shell are prevented by guide and/or centering element(s) which are fitted to the drive rod and which are positioned radially between the drive rod and the pole shell.

The guide and/or centering element(s) preferably include at least one suitable guide and/or centering element. This element preferably has dimensions at at least one point along the longitudinal axis of the drive rod such that tilting movements of the drive rod in the pole shell are substantially precluded, but in any case reduced to a minimum. In other words, the drive rod is automatically axially oriented in the pole shell or, expressed in another manner, self-centering of the drive rod in the pole shell takes place as a result.

The guide and/or centering element(s) is preferably an annular flange which, in respect of its diameter, is matched to a cylindrical shape of the pole shell in such a way that there is a more or less uniform, minimum annular gap when the drive rod is exactly oriented.

The fact that tilting movements are reduced to a minimum and, respectively, there is a minimum annular gap means that an axial longitudinal movement of the drive rod and therefore the proper functionality of the drive rod for transmitting a drive movement to the moving contact is not adversely affected by the guide and/or centering element(s), however there is no radial play of the drive rod, which radial play goes beyond the axial longitudinal movement, or the radial play is restricted as far as possible.

In this case, the guide and/or centering element is always matched to the shape of the pole shell, more precisely to the contour of the inner face of the housing of the switch pole. Therefore, the element can, for example, also have an angular shape in order to prevent tilting of the drive rod in a pole shell which has an angular cross section.

The guide and/or centering element(s) can be designed as structural elements which can be individually handled. However, in one embodiment of the invention, the guide and/or centering element(s) are not only fitted to the drive rod, but are a constituent part, in particular an integral constituent part, of the drive rod. In this case, the guide and/or centering element(s) are preferably integrally connected to the drive rod, in particular connected to the generally cylindrical main body of the drive rod in a non-detachable manner.

If, on account of structural or functional special features of the switch drive, it is merely necessary to avoid or to minimize incorrect orientation or lateral axial offset of the drive rod only in a specific radial direction, the guide and/or centering element(s) do not have to be provided on the drive rod in a manner uninterrupted at the circumference. In particular, the at least one guide and/or centering element does not have to be able to be attached to the inner face of the pole shell in a circumferential manner. In a case of this kind, it may be sufficient, for example, when the drive rod has a guide and/or centering element which has an enlarged diameter only on two opposite sides. The same correspondingly applies when, owing to special structural features, the pole shell is not closed at the circumference, that is to say there is no circumferential stop or guide surface for the guide and/or centering element at all. In these last-mentioned cases, it is sufficient to design the at least one guide and/or centering element such that it meets the structural and/or functional requirements for self-centering.

The drive rod serves not only to mechanically connect the vacuum interrupter, more precisely the moving contact of the vacuum interrupter, to the switch drive, but rather also to insulate the switch drive from the contact arrangement. In order to keep the required dielectric gap, the drive rod can have ribs which point radially outward from the rod main body and are composed of an insulating material, in order to obtain a larger creepage path. The guide and/or centering element according to at least one embodiment of the invention can be obtained in a particularly simple manner when at least one of these ribs is of enlarged design, in particular in such a way that the outside diameter of the ribs is only insignificantly smaller than the inside diameter of the pole shell at this point. The guide and/or centering element can then be produced in an extremely simple manner when manufacturing the drive rod or the ribs, for example with the aid of an injection-molding process.

The guide and/or centering element is preferably provided at that end of the drive rod or in the region of that end of the drive rod which is situated opposite the vacuum interrupter or the moving contact connection bolt of the vacuum interrupter, that is to say at that end or in the region of that end of the drive rod which faces the switch drive. In this way, any possible lateral positional deviation in the drive rod is prevented directly at the location at which force is introduced. A misaligned position on the moving contact connection bolt, which misaligned position increases on account of the geometry of the drive rod, is therefore precluded from the outset.

A misaligned position, which differs from the desired axial operating position of the drive rod, is restricted to a minimum using extremely simple means. A complicated guide system is not required for this purpose. Nevertheless, malfunctions of the contact system are precluded. Overdimensioned contact pieces are not required.

The structural design of the switch pole is not made more complicated by the invention since no additional structural elements are required. The guide and/or centering element are designed as part of the drive rod, in particular as an integral constituent part of the drive rod.

Additional costs are minimal since the centering element can be simply injection-molded onto the drive rod which is to be produced from a plastic material in any case or on the insulating ribs of the drive rod.

Embodiments of the invention can be used particularly advantageously in medium-voltage circuit breakers.

FIG. 1 shows, by way of example, a switch pole 2 of a circuit breaker 1, for example a medium-voltage circuit breaker. The two further switch poles 2 of the circuit breaker 1 are not illustrated. The switch pole 2 has a pole shell 3 in which a vacuum interrupter 4 is accommodated. The vacuum interrupter 4 serves to connect and interrupt a current which is passed across the circuit breaker 1. The details of the vacuum interrupter 4 and the design of the switch pole 2 are not illustrated in detail. However, it is known to a person skilled in the art that the fixed contact of the vacuum interrupter 4 is electrically conductively connected to a pole head 5 via a fixed contact connection bolt. The pole head 5 is connected to a switchgear assembly in which the circuit breaker 1 is used. The moving contact of the vacuum interrupter 4 is connected to a pole support 6 via a moving contact connection bolt, which pole support is in turn electrically connected to the switchgear assembly in which the circuit breaker 1 is used. The linear movement of the moving contact takes place in the direction of a central axis 7.

Following this direction, an axially moving drive rod 8 adjoins the vacuum interrupter 4 and the pole support 6, the drive rod mechanically connecting the vacuum interrupter 4 to the switch drive 9 which is merely indicated. In other words, the drive rod 8 is coupled to the moving contact, more precisely to the moving contact connection bolt of the vacuum interrupter 4.

The drive rod 8 is of electrically insulating design or has at least one insulating section in order to ensure electrical isolation between the current path on the one hand and the switch drive 9 on the other hand. Insulating ribs 12 which are at a distance from one another are provided on a cylindrical main body 11 of the drive rod 8 in order to form an adequate creepage path.

In this case, the drive rod 8 extends through the base plate of the circuit breaker 1, which base plate is arranged in the pole support 6, in order to introduce a drive movement, symbolized by arrow 13, into the moving contact connection bolt in order to open and close the contact system of the vacuum interrupter 4. The drive rod 8, which is also called an insulating bar or insulating rod and which establishes a mechanical connection between the switch drive 9 and the vacuum interrupter 4, is produced from a plastic material and, at its lower end 14 which is situated opposite the moving contact connection bolt, is connected to the switch drive 9, in particular to a mechanical lever of the switch drive 9. FIG. 1 merely shows a connecting element 15 which is fitted to the end of the drive rod 8, here in the form of a screw nut, for connecting the drive rod 8 to the switch drive 9.

The structures known from the prior art may result in a misaligned position of the drive rod 8 owing to radially acting forces, that is to say forces which act perpendicular to that central axis 7 in the direction of which the drive rod 8 executes a longitudinal movement 13 in the event of a switching process. In FIG. 1, a misaligned position of this kind is indicated, by way of example, by a line 16 which illustrates the axial position, at the end of which the indicated moving contact 17 is located. In this case, the drive rod 8, with its insulating ribs 12, is arranged freely in the pole shell 3. Expressed in another manner, the insulating ribs 12 do not make contact with the inner face 18 of the pole shell 3, even in the case of a misaligned position of the drive rod 8.

Figure 2:
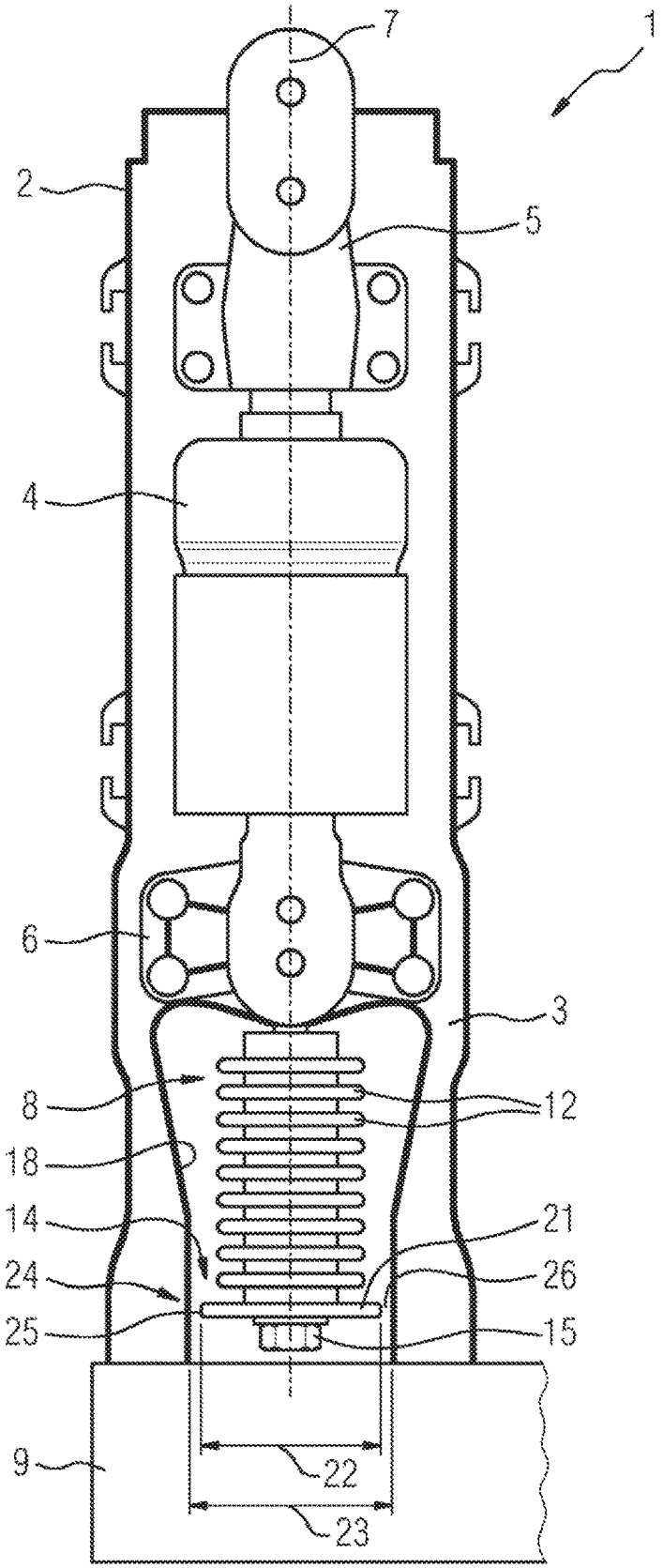
FIG. 2 shows a switch pole of a circuit breaker according to an embodiment of the invention.

The switch pole 2, illustrated in FIG. 2, of a circuit breaker 1 according to the invention differs from the switch pole 2 depicted in FIG. 1 in that an annular flange 21, of which the outside diameter 22 is somewhat smaller than the inside diameter 23 of the pole shell 3 at this axial point 24, is provided at the lower end of the drive rod 8, which end is situated opposite the moving contact connection bolt, or in this end region 14 of the drive rod 8. This annular flange 21 is a further insulating rib which is connected to the main body 11 of the drive rod 8 and serves as a guide and/or centering element, which is positioned radially between the drive rod 8 on the one hand and the pole shell 3 on the other hand, for automatically axially orienting the drive rod 8 in the pole shell 3. Like the other insulating ribs 12, the annular flange is also produced from a suitable plastic material and integrally connected to the main body 11 of the drive rod 8, in particular injection-molded onto the main body.

In the example illustrated here, the annular flange 21 which completely surrounds the main body 11 of the drive rod 8 is the only structural element present along the axis 7 of the drive rod 8 with a diameter 22 which is larger than the further insulating ribs 12. In the mounted and ideally centered state, the circumference, more precisely the casing surface 25, of this annular flange 21 forms a uniform annular gap with the inner face 18 of the pole shell 3, see FIGS. 2 and 5. A lateral movement of the drive rod 8 or, in other words, a movement in the radial direction, that is to say in the direction perpendicular to that central axis 7 in the direction of which the drive rod 8 executes a longitudinal movement 13, is therefore restricted to a minimum, specifically to the width of the annular gap 26.

If, due to a lateral, that is to say radially acting, force which is introduced into the drive rod 8 by the switch drive 9, the drive rod 8 is subjected to radial action, that is to say transverse to the central axis 7, this lateral movement is then restricted and the annular flange 21 then serves as the guide and/or centering element for guiding the drive rod 8 in the pole shell 3. Therefore, the drive rod 8 is automatically axially oriented. In these cases, mechanical contact is therefore actually made between the annular flange 21 on the one hand and the pole shell 3, more precisely the inner face 18 of the pole shell, on the other hand. If, however, the drive rod 8 is not subjected to lateral action or is subjected to lateral action only to a relatively slight extent by the switch drive 9, the drive rod 8 then moves in the desired axial direction 13, without the annular flange 21 making contact with the inner face 18 of the pole shell 3.

Figure 3:
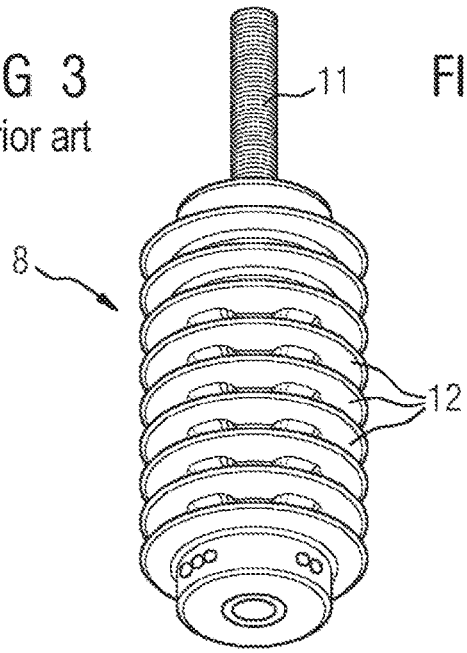
FIG 3 Prior art
FIG. 3 shows a conventional insulating bar.
Figure 4:
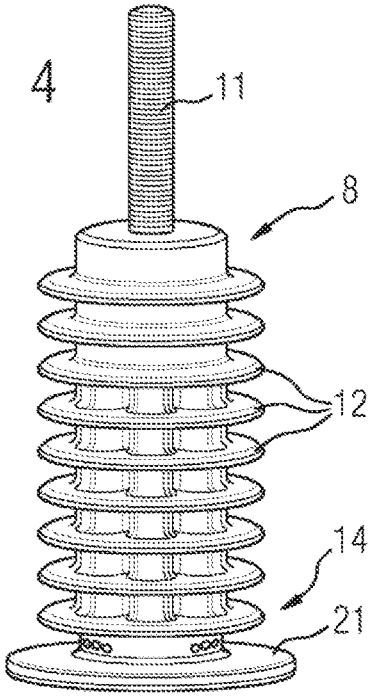
FIG. 4 shows an insulating bar according to an embodiment of the invention.

The difference between the structural design of a conventional drive rod 8 and a drive rod 8 of the switch pole 2 of a circuit breaker 1 according to an embodiment of the invention is once again illustrated in FIGS. 3 and 4.

Figure 5:
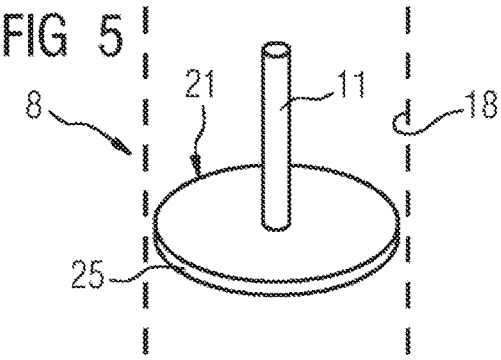
FIG. 5 shows an annular flange designed as a rib according to an embodiment of the invention.
Figure 6:
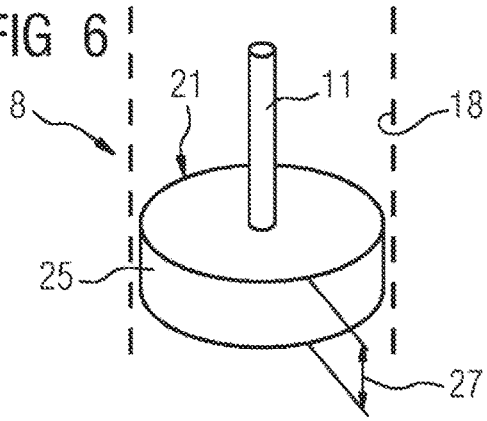
FIG. 6 shows a drive rod with an annular flange according to an embodiment of the invention.

Depending on the geometric conditions, the thickness, more precisely the axial thickness 27 of the guide and/or centering element, which is designed as an annular flange 21 for example, can also be varied. In the simplest case, the annular flange 21 is designed as a thin rib, as illustrated in FIG. 5. However, it may also be advantageous to increase the thickness of the annular flange 21 in the region of the outer rib circumference and therefore to increase the size of the contact area 25 with the inner face 18 of the pole shell 3, for example in order to minimize the risk of the drive rod 8 becoming trapped in the pole shell 3 during a switching movement. A drive rod 8 with an annular flange 21 of this kind is illustrated in FIG. 6.

Figure 7:
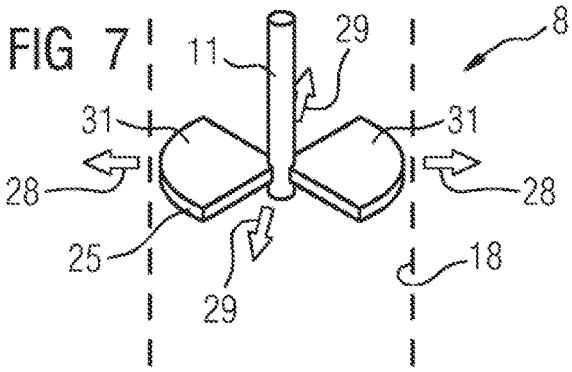
FIG. 7 shows a third guide and/or centering element.

If, on account of the structural design of the switch drive 9, it is only possible for the drive rod 8 to be subjected to a lateral action in a specific direction, neither the pole shell 3 nor the guide and/or centering element have to be of circumferential design at this point. If, for example, it is possible to act on the drive rod 8 with a transverse action only in a specific direction, as indicated in FIG. 7 by arrows 28 pointing to the right and to the left, while action in a direction perpendicular thereto is precluded, as indicated in FIG. 7 by arrows 29 pointing to the front and to the rear, the pole shell 3 can have apertures or openings at this axial point 24 on two opposite sides, that is to say at the front and rear in the example shown here, and the guide and/or centering element can be designed as an incomplete annular flange 21 with two opposite flange segments 31 which limit lateral tilting of the drive rod 8, that is to say to the right and left in the example illustrated here.

Although the invention has been illustrated and described in detail by the preferred example embodiment, the invention is not restricted to the disclosed examples and other variations can be derived from the examples by a person skilled in the art, without departing from the scope of protection of the invention.

LIST OF REFERENCE SYMBOLS

1 Circuit breaker
2 Switch pole
3 Pole shell
4 Vacuum interrupter
5 Pole head
6 Pole support
7 Central axis
8 Drive rod
9 Switch drive
10 (free)
11 Main body
12 Insulating rib
13 Switching movement
14 End region
15 Connecting means
16 Line indicating the misaligned position
17 Moving contact
18 Pole shell inner face
19 (free)
20 (free)
21 Annular flange
22 Outside diameter
23 Inside diameter
24 Axial point
25 Casing surface
26 Annular gap
27 Thickness
28 Movement to the right/left
29 Movement to the front/rear
30 (free)
31 Flange segment

The invention claimed is:

1. A circuit breaker, comprising:

a vacuum interrupter, accommodated in a pole shell and including a fixed contact and a moving contact;

a drive rod, of electrically insulating design, to introduce a drive movement from a switch drive into the moving contact in order to at least one of open and close a contact system of the vacuum interrupter; and a guide element, provided radially between the drive rod and the pole shell, to automatically axially orient the drive rod in the pole shell, the guide element including a rib arranged on the drive rod.

2. The circuit breaker of claim 1, wherein the guide element includes a dimension relatively larger than a main body of the drive rod, along a longitudinal axis of the drive rod.

3. The circuit breaker of claim 2, wherein the guide element includes a plurality of ribs, each of the plurality of ribs including a dimension relatively larger than a main body of the drive rod, along a longitudinal axis of the drive rod.

4. The circuit breaker of claim 2, wherein the guide element is an electrically insulating structural element, arranged on the drive rod.

5. The circuit breaker of claim 2, wherein the guide element is provided at an end or in a region of the end, of the drive rod facing the switch drive.

6. The circuit breaker of claim 1, wherein the guide element includes a plurality of ribs, at least one of the plurality of ribs being an annular flange, arranged on the drive rod.

7. The circuit breaker of claim 1, wherein the rib is an electrically insulating structural element.

8. The circuit breaker of claim 1, wherein the guide element is provided at an end, or in a region of the end, of the drive rod facing the switch drive.

9. The circuit breaker of claim 1, wherein the guide element includes a plurality of ribs, arranged on the drive rod.

10. The circuit breaker of claim 9, wherein each of the plurality of ribs includes a dimension relatively larger than a main body of the drive rod, along a longitudinal axis of the drive rod.

11. A circuit breaker, comprising:

a vacuum interrupter, accommodated in a pole shell and including a fixed contact and a moving contact;

a drive rod, of electrically insulating design, to introduce a drive movement from a switch drive into the moving contact in order to at least one of open and close a contact system of the vacuum interrupter; and a guide element, being connected to the drive rod and being a constituent part of the drive rod, provided radially between the drive rod and the pole shell, the guide element including a rib, arranged on the drive rod, and being configured to automatically axially orient the drive rod in the pole shell.

12. The circuit breaker of claim 11, wherein the guide element includes a dimension relatively larger than a main body of the drive rod, along a longitudinal axis of the drive rod.

13. The circuit breaker of claim 11, wherein the guide element includes a plurality of ribs, at least one of the plurality of ribs being an annular flange, arranged on the drive rod.

14. The circuit breaker of claim 11, wherein the rib is an electrically insulating structural element.

15. The circuit breaker of claim 11, wherein the guide element is provided at an end or in a region of the end, of the drive rod facing the switch drive.

16. The circuit breaker of claim 11, wherein the guide element includes a plurality of ribs, arranged on the drive rod.

17. The circuit breaker of claim 16, wherein each of the plurality of ribs includes a dimension relatively larger than a main body of the drive rod, along a longitudinal axis of the drive rod.

18. A method for axially orienting a drive rod of a circuit breaker including a vacuum interrupter, accommodated in a pole shell and including a fixed contact and a moving contact, and including a drive rod, of electrically insulating design, to introduce a drive movement from a switch drive into the moving contact in order to at least one of open and close a contact system of the vacuum interrupter, the method comprising:

automatically axially orienting the drive rod in the pole shell with aid of a guide element, provided radially between the drive rod and the pole shell and connected to the drive rod, the guide element including a rib, arranged on the drive rod.

19. The method of claim 18, wherein the guide element includes a dimension relatively larger than a main body of the drive rod, along a longitudinal axis of the drive rod.

20. The method of claim 18, wherein the guide element includes a plurality of ribs, arranged on the drive rod.

21. The method of claim 20, wherein each of the plurality of ribs includes a dimension relatively larger than a main body of the drive rod, along a longitudinal axis of the drive rod.

22. The method of claim 18, wherein the rib is an electrically insulating structural element.

23. The method of claim 18, wherein the guide element includes a plurality of ribs, at least one of the plurality of ribs being an annular flange, arranged on the drive rod.

* * * * *